United States Patent [19]

Kemp, Jr.

[11] Patent Number: 4,765,951

[45] Date of Patent: Aug. 23, 1988

[54] PROCESS FOR PRODUCING TUNGSTEN HEAVY ALLOY SHEET BY DIRECT HYDROMETALLURGICAL PROCESS

[75] Inventor: Preston B. Kemp, Jr., Athens, Pa.

[73] Assignee: GTE Products Corporation, Stamford, Conn.

[21] Appl. No.: 143,873

[22] Filed: Jan. 14, 1988

[51] Int. Cl.[4] ..... B22F 9/22

[52] U.S. Cl. ..... 419/47; 75/0.5 AB; 419/34; 419/46

[58] Field of Search ..... 75/0.5 AB; 419/34, 46, 419/47

[56] References Cited

U.S. PATENT DOCUMENTS

| | | | |
|---|---|---|---|
| 2,467,675 | 4/1949 | Kurtz et al. | 419/34 |
| 2,776,887 | 1/1957 | Kelly, Jr. et al. | 419/34 |
| 3,176,386 | 4/1965 | Grant et al. | 419/34 |
| 3,310,400 | 3/1967 | Alexander et al. | 419/47 |
| 3,318,696 | 5/1967 | Krock et al. | 419/34 |
| 3,997,331 | 12/1976 | Tither | 75/0.5 AB |

*Primary Examiner*—Wayland Stallard

*Attorney, Agent, or Firm*—Donald R. Castle; L. Rita Quatrini

[57] ABSTRACT

A process is disclosed for producing a sheet of tungsten heavy alloy which comprises forming a solution of chemical compounds containing the metal values of the alloy in the correct proportion as in the alloy, forming from the solution a precipitate of the compounds containing the metal values, removing the precipitate from the resulting liquor an forming a planar cake of the precipitate, drying the cake, and reducing the compounds in the cake to their respective metals wherein each of the resulting reduced particles is an admixture of the alloy components and sintering the cake to a density equal to or greater than about 90% of the theoretical density of the alloy to form the sheet.

1 Claim, No Drawings

PROCESS FOR PRODUCING TUNGSTEN HEAVY ALLOY SHEET BY DIRECT HYDROMETALLURGICAL PROCESS

CROSS REFERENCE TO RELATED APPLICATIONS

This invention is related to the following applications: Ser. No. 143,866 entitled "Process For Producing Tungsten Heavy Alloy Sheet", Ser. No. 143,878 entitled "Process For Producing Tungsten Heavy Alloy Sheet Using A Metallic Salt Binder", Ser. No. 143,864 entitled "Process For Producing Tungsten Heavy Alloy Sheet Using Hydrometallurgically Produced Tungsten Heavy Alloy", Ser. No. 143,869 entitled "Process For Producing Tungsten Heavy Alloy Sheet Using High Temperature Processing Techniques", Ser. No. 143,865 entitled "Process For Producing Tungsten Heavy Alloy Sheet By A Loose Fill Hydrometallurgical Process", all of which are filed concurrently herewith and all of which are assigned to the same assignee as the present application.

This invention relates to a process for producing tungsten heavy alloy sheet in which a preform cake is first formed which is substantially close in thickness to the final thickness of the rolled sheet. More particularly, the cake is formed by salts which are hydrometallurgically produced.

BACKGROUND OF THE INVENTION

Tungsten heavy alloy sheet can be produced by rolling sintered slabs of the alloy. Because the rolling requires numerous anneals it is desirable that the starting slab be no more than about twice the final thickness. One method to produce these slabs is by isostatically pressing the powder alloy blends and sintering them to full density. With thin slabs it is difficult to get a uniform fill of the mold so the resulting slabs are not uniform in thickness. There is also a problem with breakage with the thin slabs. Using this method it is not possible to produce slabs with a surface area to thickness ratio much over 600 or thickness less than about 0.5".

Another method of making tungsten heavy alloy sheet is to press large billets and cut the green billet into thin slabs. While this process produces slabs of uniform thickness it has the size limitations of the previous method and there is the added expense of cutting.

It would be desirable to make a sheet preform substantially close in thickness to the final thickness of the rolled sheet. This would reduce the time, energy, and labor required for hot rolling and annealing.

U.S. Pat. No. 2,735,757 relates to a process for forming iron metal powder from iron salts by oxidizing a solution of the iron salts to produce a hydrate sludge of the iron, followed by reducing the iron to the metal powder.

U.S. Pat. No. 3,663,667 discloses a process for producing multimetal alloy powders wherein an aqueous solution of at least two thermally reducible metallic compounds and water is formed, the solution is atomized into droplets having a droplet size below about 150 microns in a chamber that contains a heated gas whereby discrete solid particles are formed and the particles are thereafter heated in a reducing atmosphere and at temperatures from those sufficient to reduce the metallic compounds to temperatures below the melting point of any of the metals in the alloy.

U.S. Pat. No. 4,348,224 relates to a process for producing fine cobalt metal powders by digesting cobalt bearing scrap in hydrochloric acid to produce an aqueous cobalt acid chloride solution containing copper and silver ions which are removed by cementation with iron to result in a cobalt chloride solution which is processed to fine cobalt metal powder.

U.S. Pat. Nos. 3,663,667 and 4,348,224 are assigned to the same assignee as the present invention.

SUMMARY OF THE INVENTION

In accordance with one aspect of this invention, there is provided a process for producing a sheet of tungsten heavy alloy which comprises forming a solution of chemical compounds containing the metal values of the alloy in the correct proportion as in the alloy, forming from the solution a precipitate of the compounds containing the metal values, removing the precipitate from the resulting liquor an forming a planar cake of the precipitate, drying the cake, and reducing the compounds in the cake to their respective metals wherein each of the resulting reduced particles is an admixture of the alloy components and sintering the cake to a density equal to or greater than about 90% of the theoretical density of the alloy to form the sheet.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The process of the present invention relates to a hydrometallurgical process for producing tungsten heavy alloy sheet by first forming compounds of the elemental components of the alloy followed by formation of a planar cake of the compounds. This cake can then be processed to form a sheet which is substantially close in thickness to the final thickness of the rolled sheet. As a result of formation of this type of cake, there is a reduction in time, energy and labor required for hot rolling and annealing.

Some tungsten heavy alloys which are especially suited to this invention, although the invention is not limited to these, are tungsten-iron-nickel alloys especially those in which the Ni:Fe weight ratio is from about 1:1 to about 9:1 and most preferably about 8:2. As an example of these preferred alloys are those having the following composition in percent by weight: about 8% Ni, about 2% Fe, and the balance W, about 4% Ni, about 1% Fe, and the balance W, and about 5.6% Ni, about 1.4% Fe, and the balance W. The alloys can be with or without additions of Co and/or Cu.

A solution is formed of chemical compounds containing metal values of the alloy in the correct proportion as in the alloy. This can be done by any technique such as by dissolving the compounds as is in solution.

In accordance with one embodiment, the elemental metal powder components of the alloy are first dissolved in an acid solution. Calculation of the required relative amounts of the elemental powders is determined by the composition of the alloy to be produced. Dissolution of metal values in acid solution and calculation of the amounts of metal required for the alloy composition can be done by anyone skilled in the art. The acid can be a mineral acid such as hydrochloric, sulfuric, and nitric acids or an organic acid such as acetic, formic, and the like. Hydrochloric acid is especially preferred because of cost and availability. As a result of the acid dissolution of the metal powders, compounds of the respective metals are formed as precipitates. Those skilled in the art would know how to dissolve metal values in acid solution in the correct proportions.

In accordance with another embodiment, nickel powder and iron powder are dissolved in hydrochloric acid. A concentrated solution of ammonium metatungstate is added to the hydrochloric acid. A concentrated solution of ammonium metatungstate is added to the hydrochloric acid solution of nickel and iron. The amounts of iron, nickel and tungsten have been calculated to be the proper amounts to result in the desired alloy composition. The pH of the resulting solution is raised to the basic side, usually to a pH of from about 6.5 to about 7.5 with ammonia or ammonium hydroxide to precipitate tungsten as ammonium paratungstate (APT) and the iron and nickel as their hydroxides.

The precipitate is then removed from the resulting liquor by any standard technique such as by filtration.

A planar cake of the precipitate is then formed which is substantially close in thickness to the thickness of the final rolled sheet. The thickness of the sheet is typically from about 0.1" to about 0.5" after sintering and before rolling. By a planar cake is meant that the material of which the cake is made is uniform in thickness and density across the length and width of the cake. The cake is uniform in composition throughout. The preferred methods of forming the planar cake are by using a porous filter medium and applying vacuum, gas pressure, or mechanical pressure. Vibration can also be used if this is desirable. The liquid removal can be accomplished by batch or continuous processing.

The planar cake can be formed directly at the filtration step of removing the precipitate from the mother liquor.

Alternately, a slurry of the resulting preciptate is then formed in a liquid medium. The liquid medium can be water or organic solvents, which can be oxygen-containing organic solvents or non-oxygen containing organic solvents. Typical oxygen-containing organic solvents are alcohols, one in particular being reagent alcohol which has a weight composition of about 90% ethyl alcohol, about 5% methyl alcohol, and about 5% isopropyl alcohol. Other solvents that can be used are alkane hydrocarbon liquids and chlorinated hydrocarbon liquids. The slurry can have other components such as organic and inorganic binders, etc. The actual formation of the slurry can be done by standard methods.

The liquid medium is then removed from the precipitate. This is done in such a way so that the precipitate forms into the planar cake.

Before the slurry is formed, the precipitate, if it is water insoluble, can be water washed to remove contaminants.

The resulting cake is then dried by conventional powder drying techniques to remove essentially all of the liquid therefrom. The methods are selected to reduce or eliminate cracking of the cake during drying.

The cake is then reduced to the metals. This is done by standard reduction techniques. For exaple, the reduction to the metals can be done in one step or in more than one step. As an example of the latter, the dried cake is first heated to decompose the compounds into their oxides. Temperature depends on the nature of the materials. Time depends on the nature of the materials, temperature, amount of material being processed, the nature of the equipment, etc. Anyone skilled in the art would know how to reduce the compounds of the cake to the metals. In the case, of ammonium paratungstate, and nickel and iron hydroxides, the reduction is doen as follows. The reduction furnace is slowly ramped from room temperature to about 275° C. to remove ammonia and water vapor from the APT to form $WO_3$. The temperature is next ramped to 750° C. to about 1000° C. to reduce the hydroxides and oxides to their respective metals. As a result of the reduction of compounds which have been hydrometallurgically produced from solution, each of the resulting metal particulates is an admixture in itself of all the component metals which form the alloy.

The resulting cake of metals is then sintered by well known methods to a density at or near the theoretical density. This is considered to be equal to or greater than about 90% of the theoretical density of the alloy. Depending on the application and on the composition, the cake can be solid state sintered or liquid phase sintered to form the sheet. For example, if the sheet is to be rolled, it is necessary to get the density to at least about 90% to about 93% of the theoretical. With a weight composition consisting essentially of about 7% Ni, about 3% Fe, and about 90% W, solid state sintering would be sufficient. Sintering temperatures and times depend on the nature of the alloy and on the density desired for the specific application. In the example above, the solid state sintering temperature is from about 1400° C. to about 1430° C. Liquid phase sintering is preferable for better rolling, higher density and healing of cracks which can form during drying. Densities of about 99.4% of theoretical have been achieved. Usually liquid phase sintering results in a more uniform composition of the alloy components throughout the sheet. The liquid phase sintering temperature is above the solidus temperature of the matrix phase of the alloy but below the melting point of tungsten.

The resulting sheet can now be processed by known methods of hot rolling and annealing to form the final size sheet. However, when the process of the present invention is followed to produce a sheet which is close to the desired final thickness, less rolling and annealing are required than with sheets formed by prior art methods. This is because the cake has bee formed to a size very close to the desired size of the final sheet.

To more fully illustrate this invention, the following non-limiting example is presented. All parts, portions, and percentages are on a weight baiss unless otherwise stated.

EXAMPLE

About 60 parts of Ni powder are dissolved in about 240 parts of concentrated HCl and about 200 parts of water. About 25.5 parts of Fe powder is dissolved in about 120 parts of concentrated HCl and about 100 parts of water. The resulting solutions are combined. About 1103 parts of ammonium metatungstate are dissolved in about 1000 parts of water and the resulting solution is combined with the iron-nickel acid solution. The pH of the resulting solution is raised to about 6.5 to about 7.5 with ammonium hydroxide to precipitate APT, and the nickel and iron hydroxides which are then filtered off in the form of a planar cake. The cake is then reduced to the metals as follows. The reduction furnace is slowly ramped from room temperature to about 275° C. to remove ammonia and water vapor from the APT to form $WO_3$. The temperature is next ramped to 750° C. to about 1000° C. to reduce the hydroxides and oxides to their respective metals. As a result of the reduction of compounds which have been hydrometallurgically produced from solution, each of the resulting metal particulates is an admixture in itself of all the component metals which form the alloy. The reduced cake is then sintered. The sintered cake is then rolled and annealed to form the final size tungsten alloy sheet.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing a sheet of tungsten heavy alloy, said process comprising:

(a) forming a solution of chemical compounds containing metal values of said alloy in the correct proportion as in said alloy;

(b) forming from said solution a precipitate of said compounds containing said metal values;

(c) removing said precipitate from the resulting liquor and forming a planar cake of said precipitate;

(d) drying said cake;

(e) reducing the compounds in said cake to their respective metals wherein each of the resulting reduced particles is an admixture of the alloy components; and (f) sintering said cake to a density equal to or greater than about 90% of the theoretical density of said alloy to form said sheet.

* * * * *